US010465353B2

(12) United States Patent
Steinhardt et al.

(10) Patent No.: US 10,465,353 B2
(45) Date of Patent: Nov. 5, 2019

(54) WALL ELEMENT AND ASSEMBLY FOR HOLDING BACK WATER

(71) Applicants: Jörg-Michael Steinhardt, Taunusstein (DE); Winfried Vogel, Troisdorf (DE)

(72) Inventors: Jörg-Michael Steinhardt, Taunusstein (DE); Winfried Vogel, Troisdorf (DE)

(73) Assignee: Jörg-Michael Steinhardt, Taunusstein (DE)

( * ) Notice: Subject to any disclaimer, the term of this patent is extended or adjusted under 35 U.S.C. 154(b) by 0 days.

(21) Appl. No.: 16/161,095

(22) Filed: Oct. 16, 2018

(65) Prior Publication Data

US 2019/0112772 A1 Apr. 18, 2019

(30) Foreign Application Priority Data

Oct. 17, 2017 (EP) ..... 17196760

(51) Int. Cl.

| | |
|---|---|
| ***E02B 3/10*** | (2006.01) |
| ***E02B 7/22*** | (2006.01) |
| *E06B 9/00* | (2006.01) |

(52) U.S. Cl.

CPC ..... *E02B 3/106* (2013.01); *E02B 7/22* (2013.01); *E06B 2009/007* (2013.01)

(58) Field of Classification Search

CPC combination set(s) only.
See application file for complete search history.

(56) References Cited

U.S. PATENT DOCUMENTS 4,802,322 A * 2/1989 Bendfeld ..... B65D 90/24 405/52
2014/0219715 A1* 8/2014 Wolf ..... E02D 5/06 403/381

FOREIGN PATENT DOCUMENTS

| | | |
|---|---|---|
| DE | 29607619 U1 | 7/1996 |
| DE | 20317816 U1 | 3/2004 |
| DE | 102004016481 A1 | 11/2005 |

OTHER PUBLICATIONS

European Patent Office, European Search Report, dated Apr. 4, 2018, 16 pages (6-16), European Patent Office, Munchen, Germany (DE).

* cited by examiner

*Primary Examiner* — Kyle Armstrong
(74) *Attorney, Agent, or Firm* — Christopher C. Dremann, P.C.; Christopher C. Dremann

(57) ABSTRACT

A wall element for holding back water is formed in one piece and has a planar, rectangular main portion having a first side, a second side parallel to the first side, a third side perpendicular to the first side, and a fourth side parallel to the third side. A first planar bearing portion is connected to the main portion over the first side and perpendicular to the main portion. A second planar bearing portion is connected to the main portion over the second side and perpendicular to the main portion. The second bearing portion is opposite the first bearing portion. The wall element has a planar connecting portion connected to the main portion over the third side and inclined to the main portion. The connecting portion has connecting holes in the longitudinal direction, and the main portion has connecting holes along the longitudinal extent of the fourth side.

15 Claims, 8 Drawing Sheets

WALL ELEMENT AND ASSEMBLY FOR HOLDING BACK WATER

FIELD OF THE INVENTION

The invention relates to a wall element for use in an assembly for holding back water, and also to an assembly for holding back water.

BACKGROUND OF THE INVENTION AND RELATED ART

Mobile protection-wall systems are used in a variety of sectors nowadays. An example is the erection of protection walls which, in the event of a flood threat due to swollen rivers, are intended to protect inhabited land against the masses of water. Mobile protection-wall systems are only required on a temporary basis and have to be designed such that they can be constructed and dismantled with as little outlay as possible. Nevertheless, it is necessary for the protection-wall systems, in particular when used for flood protection, to withstand large forces.

A dismantleable protection-wall system for flood-protection purposes having a plurality of wall elements and a foundation, a fastening profile for fastening in the foundation being provided at least on one side of the wall elements, is known from DE 10 2004 016 481 A1. In the case of this protection-wall system, adjacent wall elements are arranged in a zigzag pattern. The angles enclosed between all the adjacent wall elements here are identical. Since the wall elements of the protection wall, rather than being arranged in alignment with one another, are arranged in different vertical planes, the surface pressure to which the wall elements are subjected by the water is not absorbed exclusively by a reaction element in the bottom region of the wall elements; rather, it is supported in part by the adjacent wall elements, by a reaction force of which the line of action runs within the wall plane. In particular, all the wall elements are of identical design, and it is therefore possible to form a regular zigzag pattern.

The disadvantage with this dismantleable protection-wall system is that the wall elements interact with a foundation. Accordingly, the protection-wall system is not suitable for construction on a location-independent basis. It can only ever be used in conjunction with the foundation. The mounting of the wall elements in the foundation means that it is necessary to have a particular profiling of the respective wall element and also the foundation, which interacts with said wall element. Therefore, the foundation has a profiled mount corresponding to the fastening profile of the wall element. Said fastening profile is an angled material strip of the wall element. In addition, the profiled mount accommodates a sealing cord, so that sufficient sealing is achieved between the wall element and the foundation. This construction as a whole therefore also involves a fair amount of outlay in structural terms.

Steinhardt GmbH's product information "Steinhardt HYDROSWIZZ/SchutzWand im Zick-Zack", as at 03/14, describes an emergency flood-protection wall with a ground seal. Individual wall elements here are screw-connected to a connection element arranged between them, and are positioned in a zigzag arrangement. The wall elements and the connecting elements are sealed in the direction of the ground surface via a seal. Said flood-protection wall is weighted from above, by a plank or board being positioned on the flood-protection wall for example from above and by sandbags or blocks being positioned on said plank or board.

The dismantleable protection-wall system according to DE 10 2004 016 481 A1 is described, in addition, at www.swizz-schutzwand.com, under "Mobile Schutzwand—Konstruktion/Auf—and Abbau/Transport—Lagerung".

OBJECTS AND SUMMARY OF THE INVENTION

It is an object of the present invention to develop a wall element so as to be a structurally particularly straightforward construction element for the location-independent erection of an assembly for holding back water. It is also an object of the invention, in relation to this aspect, to create a particularly straightforwardly and advantageously configured assembly for holding back water, having a plurality of wall elements.

The object is achieved, as far as the wall element is concerned, by such a wall element designed in accordance with the present invention.

The wall element is used in an assembly for holding back water. The assembly under consideration here is not just a flood-protection wall, but also one for other use purposes, in particular a water basin. In the case of this water basin, the base is formed by a ground surface, and therefore an underlying surface, for example a horizontal tarred surface, and the encircling, and therefore closed, wall of the water basin is formed by the individual wall elements which are arranged in an encircling formation, connected to one another and are sealed in the direction of the ground surface. Such a water basin constitutes, for example, a storage basin for fire-fighting water.

The wall element is formed in one piece and has a planar, rectangular main portion having a first side, a second side, which is arranged parallel to the first side, a third side, which is arranged perpendicularly to the first side, and a fourth side, which is arranged parallel to the third side. The wall element also has a first, planar bearing portion, which is connected to the main portion in the region of the first side, over the length of the latter, and is arranged perpendicularly to the main portion, and a second, planar bearing portion, which is connected to the main portion in the region of the second side, over the length of the latter, and is arranged perpendicularly to the main portion. The second bearing portion is arranged opposite to the first bearing portion, as seen in relation to the main portion. The wall element has a planar connecting portion, which is connected to the main portion in the region of the third side, over the length of the latter, and is inclined in relation to the plane of the main portion. The connecting portion is provided with a plurality of connecting holes, which are arranged in the longitudinal direction of the connecting portion and pass through the latter. The main portion, in the region of the fourth side, has connecting holes which correspond to the number of connecting holes of the connecting portion and are arranged along the longitudinal extent of the fourth side. That surface of the first and second bearing portions which is directed toward the main portion is a contact surface for fastening means for connecting the wall element to the ground surface. That surface of the first and second bearing portions which is directed away from the main portion is a bearing surface for a seal which is to be arranged between the respective bearing surface and the ground surface.

Designing the wall element with the first bearing portion and the second bearing portion means that the wall element can be positioned either with the first bearing portion oriented in the direction of the ground surface or with the second bearing portion oriented in the direction of the ground surface. This design makes it possible, by virtue of wall elements being lined up in a row, and therefore fastened to one another, for the wall elements to be arranged in a zigzag formation or else in a non-zigzag formation. This is governed by the use purpose of the assembly for holding back water.

Since, in the case of the wall element, that surface of the first and second bearing portions which is directed toward the main portion constitutes a contact surface for fastening means for connecting the wall element to the ground surface, it is not necessary for a foundation, with which the respective wall element interacts, to be provided in the ground surface. Rather, the respective wall element can be positioned in a location-independent manner, because all that is necessary at the respective set-up site of the wall element, or of the assembly for holding back water which is formed by the wall elements, is for the fastening means to be brought into contact with the contact surface of the respective bearing portion and for the fastening means to be connected to the ground surface. This configuration means that the sealing of the respective wall element in the direction of the ground surface can take place significantly more straightforwardly than in a solution in which a wall element interacts with the foundation, with the interposition of a sealing element. In the case of the wall element according to the invention, that surface of the first and second bearing portions which is directed away from the main portion is a bearing surface for a seal which is to be arranged between the respective bearing surface and the ground surface.

The operation of setting up the respective wall element is therefore a very straightforward one: all that is required is for the seal to be positioned in the region of that end of the wall element which is directed toward the ground surface, in particular for the seal to be connected to the wall element, and then for the wall element to be connected to the ground surface by the fastening means in the region of the bearing portion which is assigned to the ground surface. For this purpose, use is made, in particular, of screws or nails, possibly in the case of the respective fastening means having an additional specific configuration. The respective bearing portion is preferably provided with connecting holes arranged in pairs. If a problematic underlying surface means that a screw or a nail cannot be placed in the ground surface through one hole of the pair, the second hole of the pair is still available for this purpose.

According to an advantageous development of the invention, provision is made for the wall element to consist of metal. In particular, the wall element is formed from sheet metal, this preferably being a galvanized sheet metal.

The wall element can be produced particularly straightforwardly from a planar metal sheet which is angled a number of times, namely along two parallel lines for the purpose of forming the two bearing portions, which are then parallel to one another, but are directed oppositely to one another as seen in relation to the main portion generated here. A further, third angling operation takes place in the region of the connecting portion, which is inclined in relation to the plane of the main portion. In particular, the connecting portion encloses an angel of 120 to 150°, preferably 130 to 140°, and more preferably 135°, with the main portion. Since the planar connecting portion is inclined in relation to the planar main portion, it is not possible for two adjacent wall elements to be arranged in a single plane; rather, they are at an angle. This is the prerequisite for forming the zigzag arrangement of the wall elements for the purpose of forming the assembly for holding back water.

The fastening means which interact with the contact surface can be configured in different ways. According to a preferred configuration, provision is made for the contact surface for fastening means to serve to provide contact for clamping brackets, at least in the two mutually remote end regions of the bearing portion, as seen in relation to the longitudinal extent of the respective bearing portion, wherein the clamping brackets each have at least one mount for a screw or a nail. In the case of this design of the fastening means, the nails or screws indeed likewise constitute the connection to the ground surface, and are therefore driven into the ground surface and screw-connected to the ground surface. However, it is not necessary for the screws or nails to pass through connecting holes in the bearing portions. Instead, the clamping brackets engage behind those bearing portions of the wall elements which are directed toward the ground surface and establish contact with the contact surfaces of the bearing portions. The clamping brackets thus engage behind the respective wall element in the region of the bearing portion which is directed toward the ground surface, and brace the bearing portion against the ground surface.

According to an advantageous alternative, provision is made for the contact surfaces for fastening means to serve to provide contact for fastening means designed in the form of screws or nails, the contact being provided in the region of the head of said fastening means, wherein the respective bearing portion has connecting holes for the screws or nails. In this case, there is therefore no need for any clamping brackets. Fastening takes place exclusively by means of the screws or nails. However, it is necessary here for the respective bearing portion to be provided with the connecting holes.

In particular, provision is made for adjacent connecting holes of the respective bearing portion to be spaced apart from one another by the same distance, as seen in relation to the longitudinal extent of the bearing portion. This ensures a uniform distribution of the forces which draw the wall element against the ground surface. In particular, the connecting holes are distributed uniformly over the entire length of the bearing portion.

As far as the connection of adjacent wall elements to one another is concerned, it is considered to be particularly preferred if adjacent connecting holes of the connecting portion are spaced apart from one another by the same distance, as seen in relation to the longitudinal extent of the connecting portion, and adjacent connecting holes of the main portion are spaced apart from one another by the same distance, as seen in relation to the longitudinal extent of the fourth side of the main portion, wherein said distances between adjacent connecting holes of the main portion and connecting portion are identical, and the distances between those connecting holes of the main portion and connecting portion which are closest to the extension of the first side of the main portion are identical. This configuration provides for straightforward connection of second wall elements because, in the case of an overlap of the main portion, in the region of the first side thereof, and of the connecting portion, the connecting holes of the main portion and connecting portion are aligned with one another.

Preferably at least some of the connecting holes of the main portion and/or connecting portion are designed in the form of slots. In particular, the connecting holes of the main portion are of circular design and a connecting hole arranged halfway along the connecting portion is of circular design and at least two other connecting holes of the connecting portion, which have the circular connecting hole located between them, are designed in the form of slots. The slots extend longitudinally parallel to the first and second sides of the main portion. As a result of this configuration, when the wall elements, which are to have their main portions arranged vertically, are to be installed on an underlying surface which is not quite planar, in other words a non-planar ground surface, it is possible to compensate for slight differences in angle, although a fixed connection of the wall elements in the region of overlap between the main portion and connecting portion is ensured.

As far as the aspect of the sealing of the respective wall element in the direction of the ground surface is concerned, it is considered to be particularly advantageous if that surface of the first or second bearing portion which is directed away from the main portion is a bearing surface for adhesive-bonding connection to the seal or for insertion, in particular adhesive-bonding insertion, of the seal into the first or second bearing portion or for fitting the seal into the first or second bearing portion.

In particular as far as the mounting of a multiplicity of wall elements is concerned, it is advantageous if the wall elements are of identical design. In particular, the wall elements are stackable, in a state in which they rest one upon the other in the region of the main portions. Against this backdrop, it is advantageous if the seal is installed, and therefore connected to the wall element and/or arranged between the wall element and ground surface, for the first time immediately prior to the wall element being installed or prior to the assembly for holding back water being installed. The wall element can be installed particularly straightforwardly if, during the installation operation, the seal has already been connected to the wall element, for example by a form fit, such as by being fitted on, or by adhesive bonding, in the region of the first or second bearing portion.

The object is also achieved by an assembly for holding back water. In the case of this assembly for holding back water, with a plurality of wall elements, provision is made for said wall elements to be arranged in zigzag form or in a closed configuration, wherein the wall elements are screw-connected in the region of the main portion and connecting portion, and a seal is arranged between the ground surface and the respective bearing portion assigned to the ground surface, and also provided are fastening means, which establish contact with the respective contact surface of the ground-side bearing portion and are screwed, or driven, into the ground surface.

In particular, the sealing of the wall elements in the direction of the ground surface takes place via seals which are adhesively bonded to the respective ground-side bearing portion, over the entire length of the latter, or are fitted onto the respective bearing portion from the ground surface beneath said bearing portion, over the entire length of the latter, in particular with additional adhesive bonding, or are fitted onto the respective bearing portion along the transverse extent of the latter.

The seal is preferably a lip seal, a seal made of sponge rubber, in particular of foam rubber, or a seal which hardens under the action of water. As water is accumulated, said seal becomes impregnated and a solvent absorbed by the seal is activated, as a result of which the seal becomes relatively solid, whereby a good sealing action is established.

In the case of the respective wall element being connected to the ground surface by means of a clamping bracket, provision is made in particular for the respective clamping bracket to have a central through-hole for the screw or the nail, and for said clamping bracket, on one side, to have two end-side edges which enclose an angle >180° and, on another side, in particular a side directed away from the first, to have two end-side edges which enclose an angle <180°. In particular, said angle <180° is an angle of 120° to 150° and the angle >180° is an angle of 210° to 240°. In a specific exemplary embodiment, the one angle is 135° and the other angle is 225°. This particular design of the clamping bracket makes it possible for the latter to be positioned in the region of connection between two adjacent wall elements. The respective clamping bracket establishes contact with the contact surfaces of the ground-side bearing portions of the two wall elements. If the wall elements are located, for example, at an angle of 135° in relation to one another, the clamping bracket is used in the position in which the two end-side edges enclose an angle of 135°. If the two adjacent wall elements, instead, are arranged at an angle of 225° in relation to one another, use is made of the other side of the clamping bracket, in the case of which the two end-side edges enclose an angle of 225° with one another.

According to an advantageous development, provision is made for the assembly for holding back water to have at least one support, which is connected, in particular screwed, to a wall element and is connected to the ground surface by fastening means. Said support engages in a region adjacent to the upper end of a wall element, for example in the region of connection between the two wall elements, and supports the wall element, or the assembly for holding back water, in relation to the water relatively high up.

The assembly for holding back water is, in particular, a flood-protection wall or an encircling wall of a water basin, which is formed by said wall and a base. If the assembly is a flood-protection wall, the latter is connected, in the region of the end wall elements, to a stationary element, for example a building connection, and is preferably screwed to said building connection in a manner corresponding to the connection to the other wall element.

Further features of the invention are presented in the brief description of the drawings and the detailed description of embodiments of the invention provided hereafter.

BRIEF DESCRIPTION OF THE DRAWING FIGURES

The invention is illustrated in the following drawing figures by way of exemplary embodiments, without being restricted thereto.

DETAILED DESCRIPTION OF EMBODIMENTS OF THE INVENTION

Figure 1:
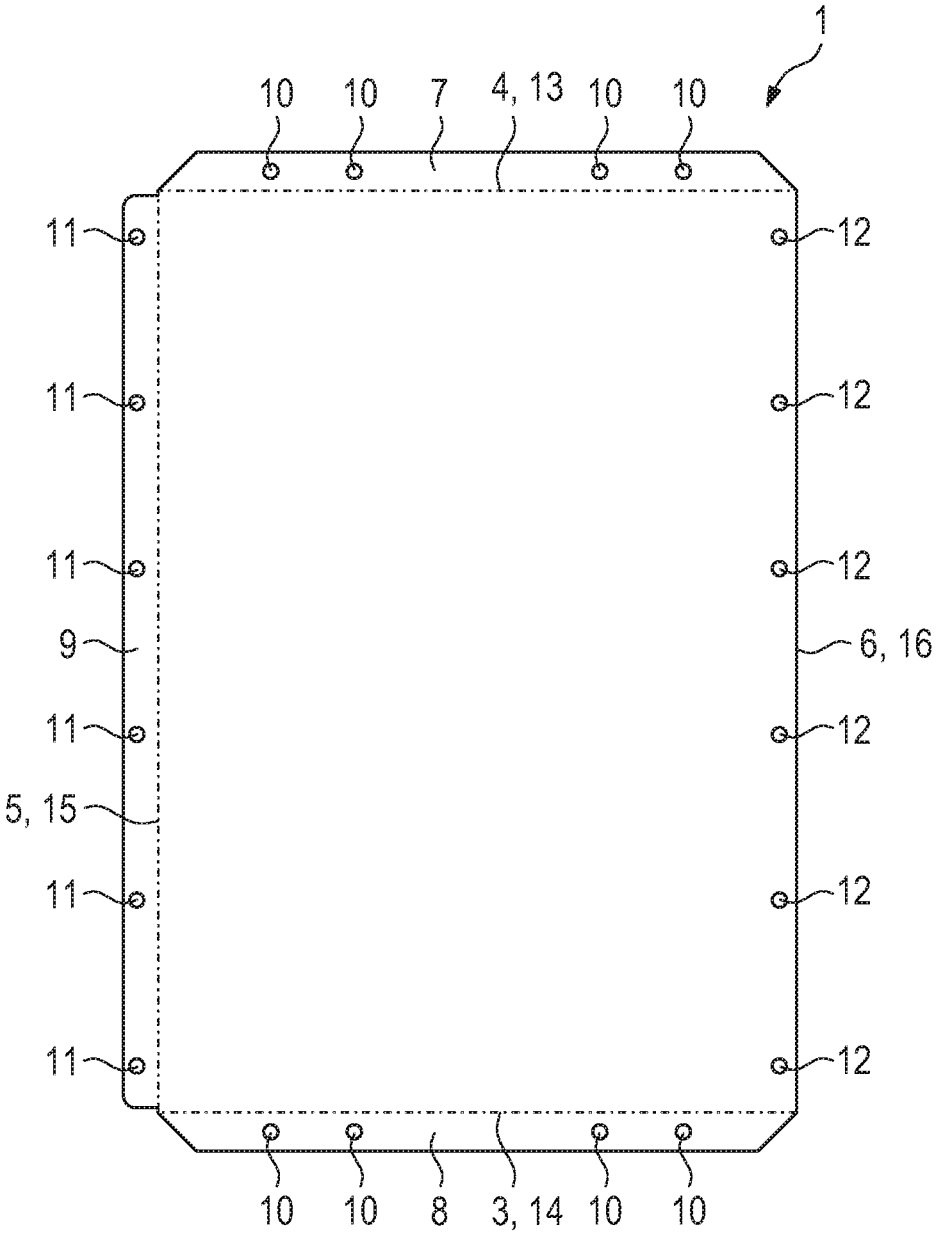
FIG. 1 shows a sheet-metal blank for producing a wall element, depicted in a plan view of the blank.

FIG. 1 shows a sheet-metal blank 1 for forming a wall element 2, which in the installed state is approximately 1000 mm high, approximately 650 mm wide and approximately 3 mm thick. The sheet-metal blank is a lasered sheet-metal panel prior to being angled.

The sheet-metal blank has three bending lines, namely the bending lines 3 and 4, which are arranged parallel to one another, and the bending line 5, which is arranged perpendicularly to the bending lines 3 and 4. Said bending lines 3 to 5 subdivide the sheet-metal blank 1 into a rectangular main portion 6, a first bearing portion 7, a second bearing portion 8 and a connecting portion 9. The two bearing portions 7 and 8 are of identical design and have an identical pattern of four connecting holes 10, which are arranged in a row parallel to the bending line 3, 4. Two connecting holes 10 of the respective bearing portion 7, 8 are arranged relatively closely together, whereas there is a larger distance between the second and third connecting holes 10 of the respective bearing portion 7, 8. The connecting holes 10 are arranged symmetrically in relation to the longer axis of symmetry of the main portion 6.

The connecting portion 9 is provided with six connecting holes 11, which are each spaced apart uniformly from one another and are arranged essentially along the length of the connecting portion 9. These connecting holes 11 each have a circular cross section. On the side which is directed away from the connecting portion 9, the main portion 6 is provided with six connecting holes 12. These are arranged in a manner identical, as seen in relation to the longitudinal extent of the main portion 6, to the connecting holes 11. Therefore, a respective connecting hole 11 is located on the same line as an associated connecting hole 12, as seen in relation to a line parallel to the bending line 3, 4.

Figure 2:
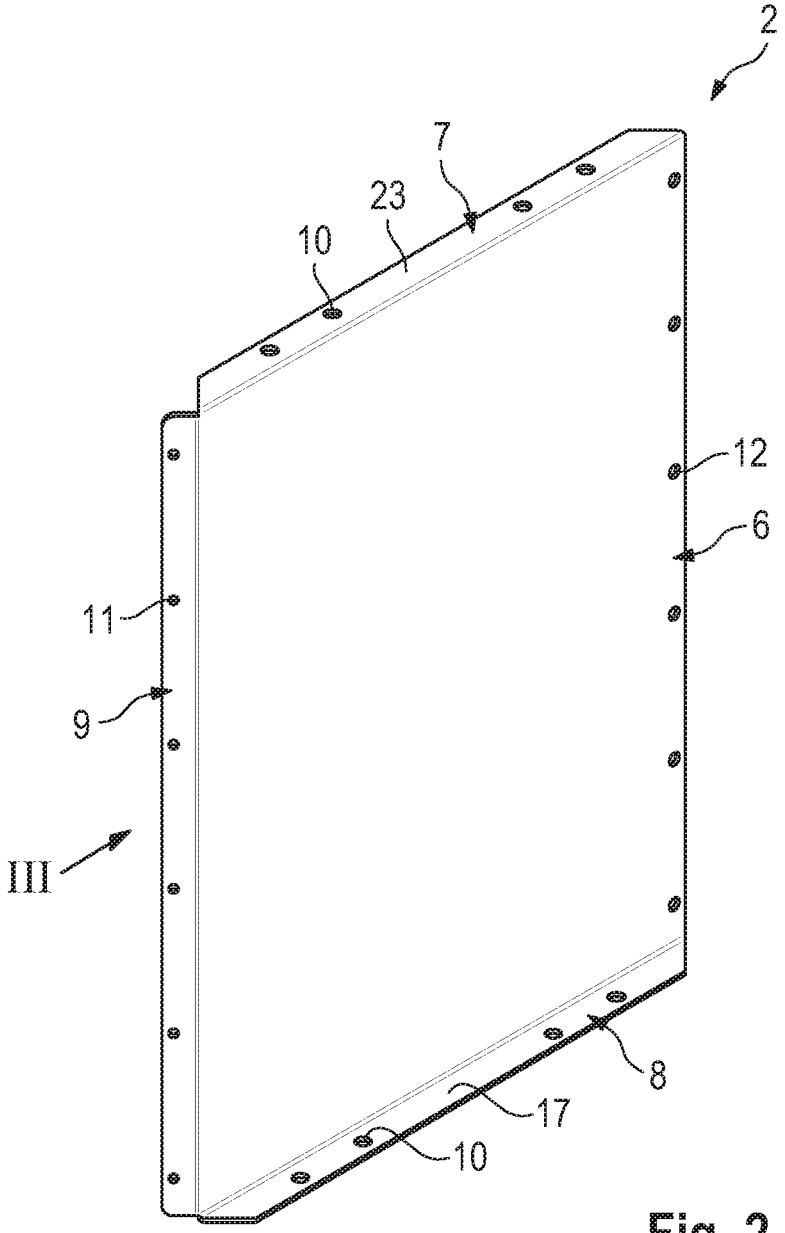
FIG. 2 shows a three-dimensional view of the wall element produced from the blank.
Figure 3:
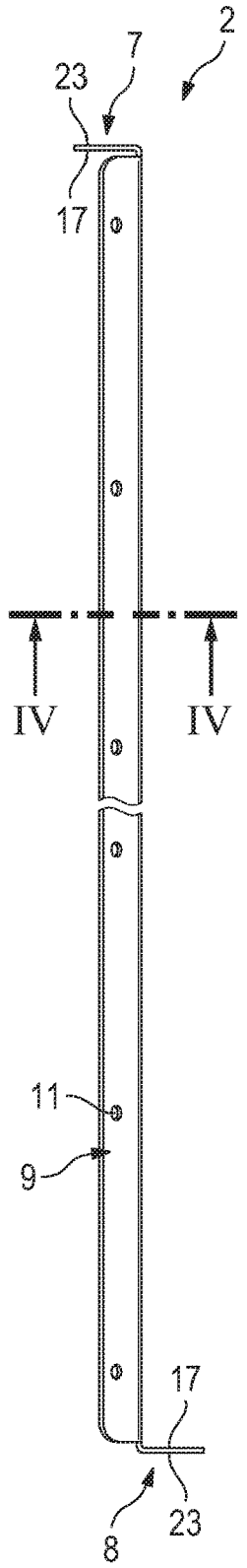
FIG. 3 shows a view III of the wall element shown in FIG. 2.
Figure 4:
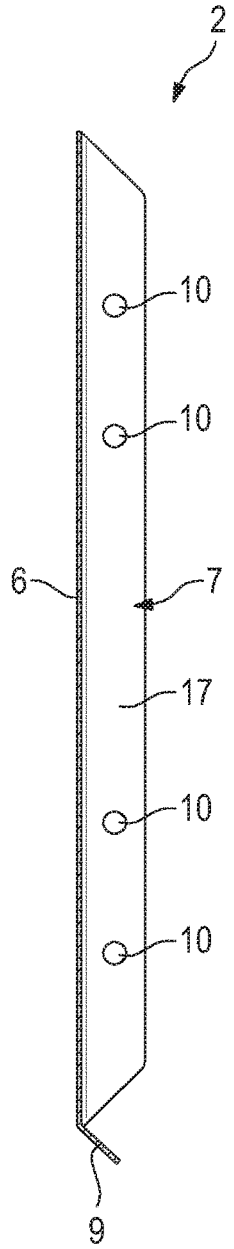
FIG. 4 shows a section through the wall element taken along line IV-IV in FIG. 3.
Figure 5:
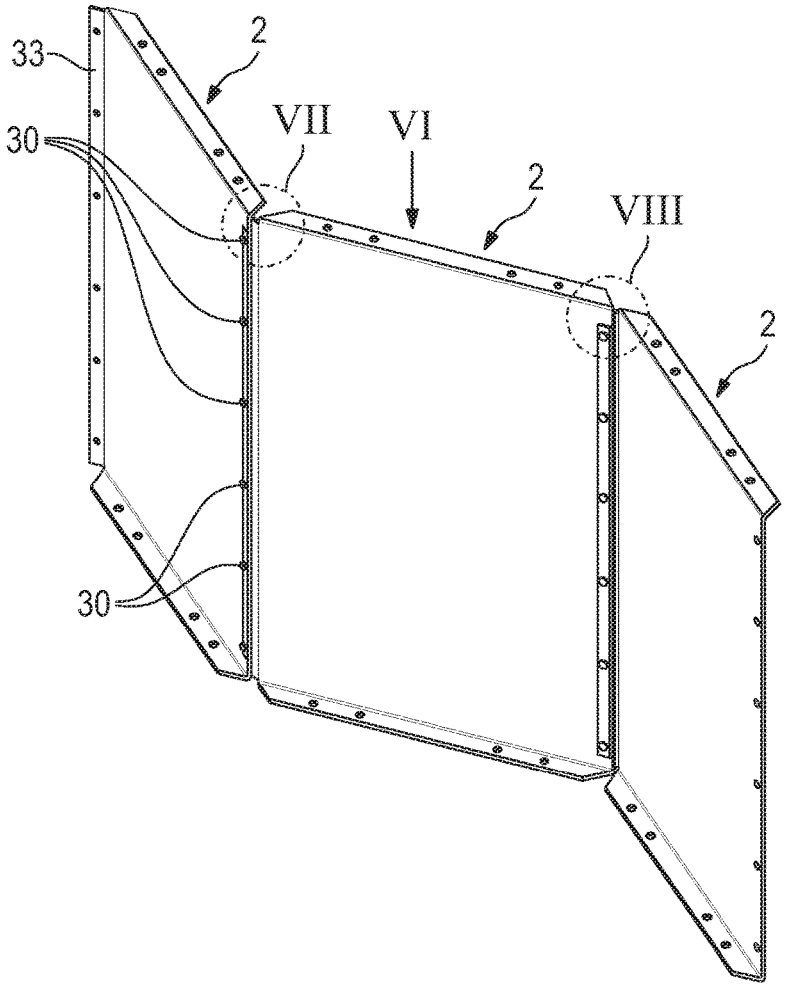
FIG. 5 shows a three-dimensional arrangement of three wall elements connected to one another in zigzag form for use in an assembly for holding back water.
Figure 6:
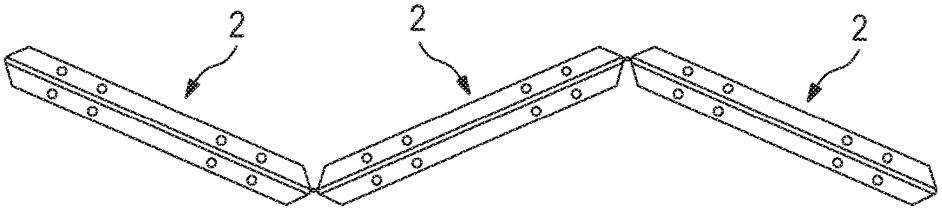
FIG. 6 shows a view VI of the arrangement illustrated in FIG. 5.
Figure 7:
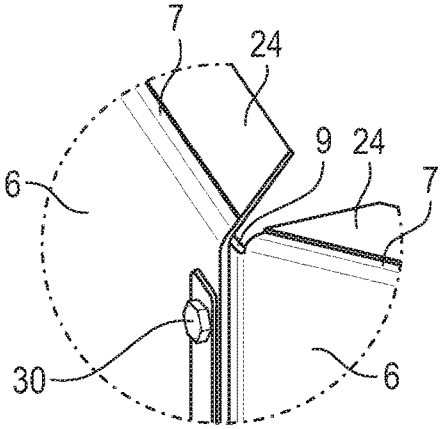
FIG. 7 shows an enlarged illustration of the region VII in FIG. 5.
Figure 8:
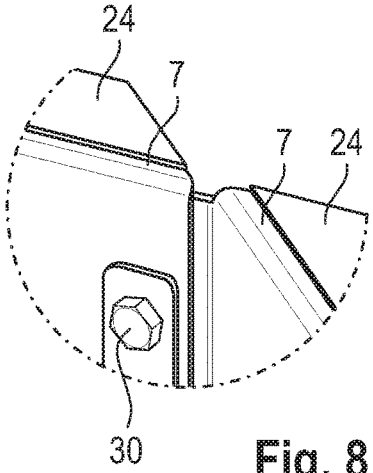
FIG. 8 shows an enlarged illustration of the region VIII in FIG. 5.

In the case of the sheet-metal blank 1 described thus far, the first bearing portion 7 is bent downward through 90° around the bending line 4 in relation to the plane of the main portion 6, and the second bearing portion 8 is bent upward through 90° around the bending line 3 in relation to the planar main portion 6. The connecting portion 9 is bent downward through 45° about the bending line 5, as seen in relation to the planar main portion 6. This results in the formation of the wall element, as illustrated in FIGS. 2 to 4.

The wall element therefore has, and to this extent simplicity will be served by referring to the sheet-metal blank 1, a first side 13, a second side 14, which is arranged parallel to the first side 13, a third side 15, which is arranged perpendicularly to the first side, and a fourth side 16, which is arranged parallel to the third side 15. The two planar bearing portions 7 and 8 are of identical design and are in the shape of a trapezoid, wherein the long side of the trapezoid extends over the entire length of the first side 13 and second side 14 of the main portion 6. The connecting portion 9 is likewise of planar design and extends over the entire length of the third side 15 of the main portion 6, or more or less over the entire length of said third side 15. The connecting portion 9 is of rectangular design, with the exception of rounded corners, which are directed away from the third side 15 of the main portion 6. The connecting holes 12 are adjacent to the fourth side 16 of the main portion 6. Said connecting holes 12 are designed in the form of slots, with a longitudinal orientation perpendicular to the fourth side 16 of the main portion 6.

The respective surface 17 of the first bearing portion 7 and second bearing portion 8 (see FIG. 3), said surface being directed toward the main portion 6, is a contact surface for fastening means 18 (see FIGS. 12 and 13) for connecting the wall element 2 to a ground surface 19. This ground surface 19 is, for example, a paved underlying surface. According to the exemplary embodiment, the respective fastening means 18 comprises a clamping bracket 20 and a screw 22, which passes through a hole 21 in the clamping bracket 20. The clamping bracket 20 establishes contact with the respective bottom bearing portion 7 or 8, in the region of the surface 17, and the clamping bracket 20 draws the bearing portion 7 or 8, and therefore the wall element 20, against the ground surface 19 via the screw 22, screwed into the ground surface 19, in particular via the screw 22 screwed into a plug anchored in the ground surface. Instead of using one or more clamping brackets 20, which interact(s) with the contact surface, therefore the surface 17, of the respective bearing portion 7 or 8, it is possible just to use a screw 22. This is fitted through the holes 10 and screw-connected in the ground surface.

Which bearing portion 7 or 8 is clamped by the fastening means 18 depends on the orientation of the wall element 2, namely on whether said wall element 2 is positioned on the ground surface 19 with the first bearing portion 7 located at the bottom or with the second bearing portion 8 located at the bottom.

The surface which is directed away from the contact surface for the fastening means 18, therefore the surface 23 of the first bearing portion 7 and second bearing portion 8, said surface 23 being directed away from the main portion 6, is a bearing surface for a seal 24 which is to be arranged between the respective bearing surface and the ground surface 19.

Figure 9:
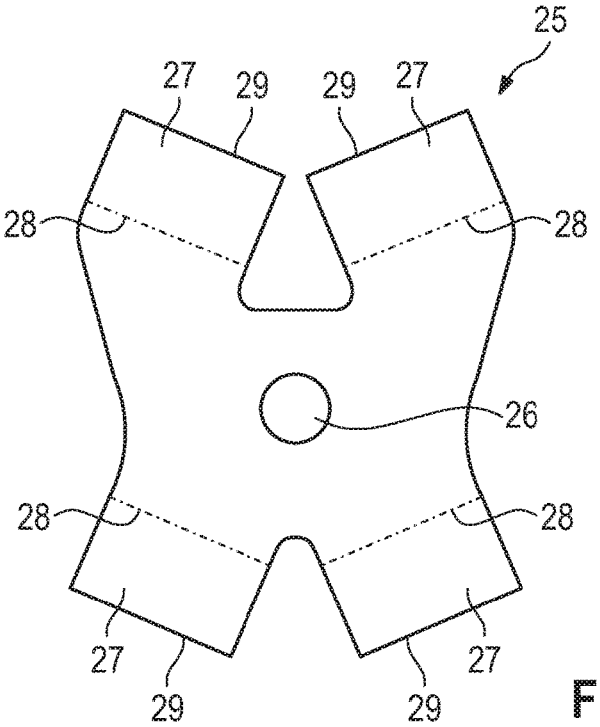
FIG. 9 shows a plan view of a sheet-metal blank of a clamping bracket which is used in one embodiment of the fastening means.
Figure 12:
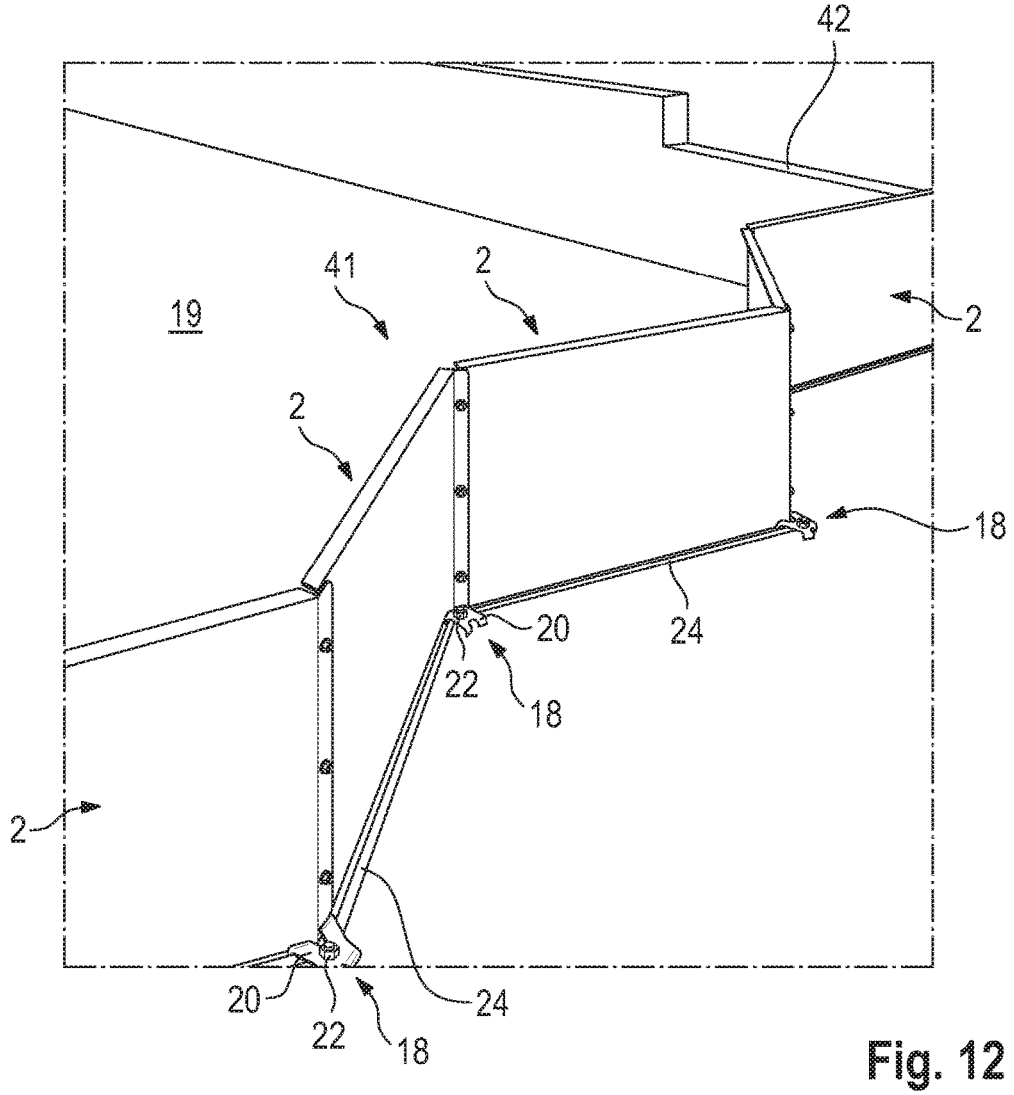
FIG. 12 shows a three-dimensional arrangement of five wall elements which are connected to one another, fastened to a ground surface and form a sub-region of an assembly for holding back water.
Figure 13:
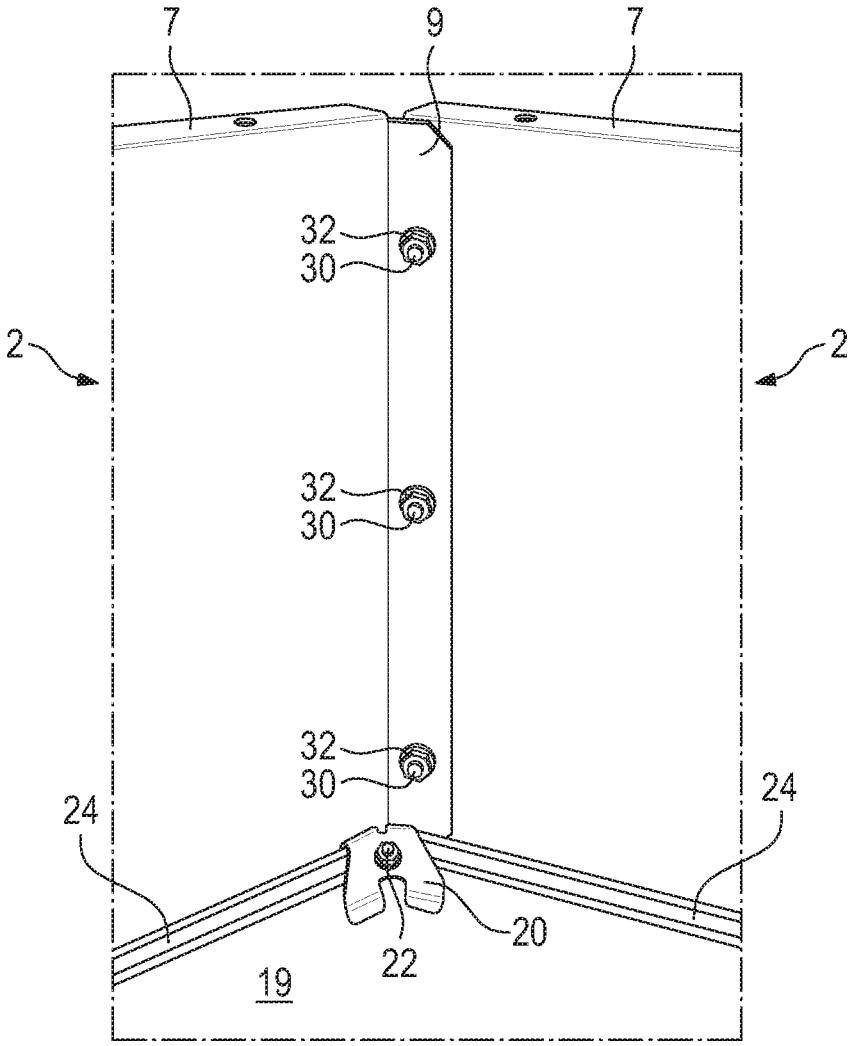
FIG. 13 shows a detail-specific illustration of a sub-region of two connected wall elements according to FIG. 12, in the region of the clamping bracket.

FIG. 9 shows a sheet-metal blank 25 for producing a clamping bracket 20. The sheet-metal blank 25 is H-shaped, with a central through-hole 26 for the screw 22 and four free clamping-bracket portions 27, which are each assigned a bending line 28, which is arranged parallel to an edge 29 which delimits said clamping-bracket portion 27. The edges 29 of two adjacent clamping-bracket portions 27 enclose an angle of 135°; the edges 29 of the two other clamping-bracket portions 27 enclose an angle of 225°. As seen in relation to the plane of FIG. 9, the respective clamping-bracket portions 27 are bent downward through 90° around the associated bending lines 28 to give the formation of the clamping bracket 20 which is shown in FIGS. 12 and 13. The respective clamping bracket 20 is positioned in the region of connection between two adjacent wall elements 2. In the case of two wall elements 2 being arranged at an angle of 135°, the clamping bracket 20 is positioned on the two lower bearing portions of the wall element 2 and braced against the surface 17 by means of the screw 22, the seal 24 being positioned beforehand between said bearing portions and the ground surface 19. If the wall elements 2, in contrast, are arranged at an angle of 225° in relation to one another, the respective clamping bracket 20 can be positioned on one or both lower bearing portions of the two wall elements 2 and braces said wall element 2, or said wall elements 2, against the ground surface 19, with the seal 24 being arranged therebetween.

Figure 10:
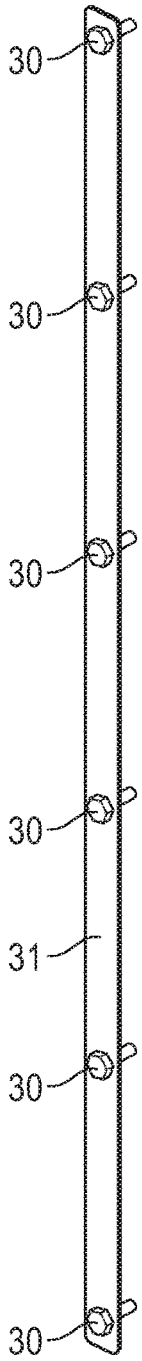
FIG. 10 shows a three-dimensional view of a retaining strip with screws accommodated thereby.

FIGS. 5 to 8 show the arrangement of three wall elements 2 connected to one another. The two wall elements 2 can be connected particularly straightforwardly here if, as is depicted in addition in the illustration of FIG. 10, screws 30 are retained in a preassembled state, for example by a flexible adhesive-bonding connection, in a perforated strip 31, wherein the pattern of holes in the perforated strip 31 corresponds to the spacings between the connecting holes 11. Therefore, when the perforated strip 31 is positioned against the wall element 2 in a defined manner, all the screws 30 can be fitted through the connecting holes 11 and 12 of the two wall elements 2, and need only be screwed into corresponding nuts 32. Prior to the wall elements 2 being screwed together, and the wall elements 2 being installed on the ground surface 19, the bearing portions 7, 8 can be adhesively bonded to the seal 24 in full in the region of their surfaces 23, for example a seal 24 made of a foam-rubber layer is adhesively bonded onto said surface 23. It is also quite possible for the wall elements 2 already to have been delivered with the seals 24 adhesively bonded to the surfaces 23, and therefore for the two bearing portions 7, 8 to be provided with adhesive bonding so that, depending on the position selected for the wall element 2, either bearing portion 7 at the top or bearing portion 7 at the bottom, the wall element 2 is always already present with the seal 24 in place. It is also advantageous if the connecting portion 9, in the region of connection to the main portion 6, is also adhesively bonded to a seal 33, in particular a seal made of a foam-rubber strip. This ensures optimum sealing overall not just in relation to the ground surface 19, but also between the connected wall elements 2.

Figure 11:
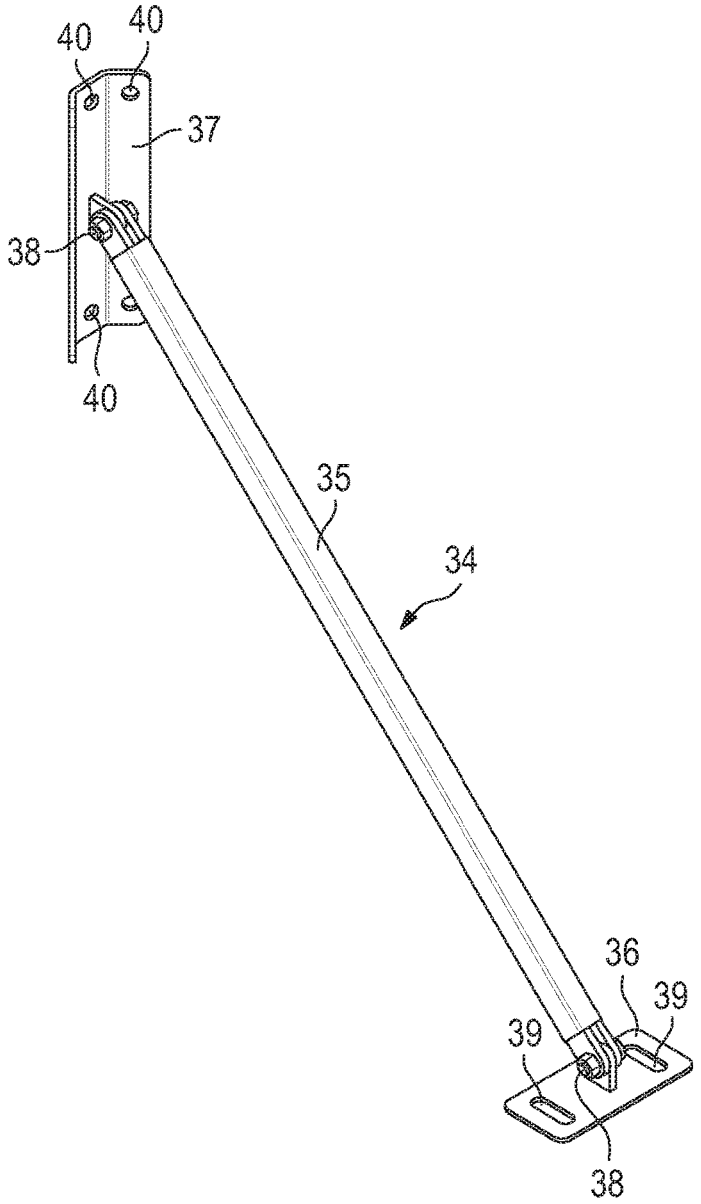
FIG. 11 shows a three-dimensional view of a support for supporting a wall element.

FIG. 11 shows a support 34 which can likewise be used in addition and is intended for supporting a wall element 2, or two wall elements 2, in the connecting region thereof, at a relatively large distance from the ground surface 19. The support has a central bar 35, which, in the region of its lower end, is connected in an articulated manner to a base plate 36 and, in the region of its upper end, is connected in an articulated manner to a supporting plate 37. The respective articulated connection 38 is achieved by a screw/nut connection between the parts. The base plate 36 is provided with two parallel slots 39 on either side of the site where the bar 35 is attached to it, and the supporting plate 37, in the form of a twice-angled plate, is provided with a plurality of holes 40. The plate is positioned in the region of connection between two wall elements 2 and screw-connected by means of the screws 30 in addition to the connection between the wall elements 2. The respective screw 30 is therefore fitted not just through the main portion 6 of the one wall element 2 and the connecting portion 9 of the other wall element 2, but also through the corresponding hole 40 of the supporting plate 37, and the nut 32 is then screwed on. The base plate 26 is anchored in the ground surface 19 by means of screws which are fitted through the slots 39 and screwed into the ground surface, or else it is anchored in the described manner by being clamped by means of a clamping bracket 20 and screw 22.

FIGS. 12 and 13 show a variant of the sealing of the wall elements 2 in the direction of the ground surface 19, said wall elements 2 also having a lower height. The seal 24 here consists of elastic material and is fitted onto the bearing portion 7 or 8 arranged at the bottom, the fitting-on direction running in the plane of the bearing portion. The seal therefore surrounds the bearing portion, more or less in the form of a U, and therefore butts against the bearing portion 7 or 8 both in the region of the surface 23 and in the region of the surface 17.

It can be gathered from the illustration of FIG. 12 that the various wall elements 2 form a zigzag assembly 41 for holding back water. This assembly 41 has remote end regions, as seen in relation to the horizontal extent of the assembly 41, connected, in particular screw-connected, to walls 42 of building structures. The connecting holes 11 and 12 are likewise provided for this purpose. On the other hand, it is possible for the various wall elements 2 to be connected such that they form a closed arrangement, which is connected to the ground surface 19. In this case, the wall elements 2 form a container or tank for accommodating water, for example fire-extinguishing water, a water basin being formed as a result.

In the case of the exemplary embodiment according to FIGS. 12 and 13, the connecting holes 12 of the main portion 6 are of circular design. A connecting hole 11 arranged halfway along the connecting portion 9 is of circular design. Two other connecting holes 11 of the connecting portion 9, which have the circular connecting hole 11 located between them, are designed in the form of slots 11, which extend longitudinally parallel to the first and third sides of the main portion 6. It is not just the design of the slots 12 in the blank according to FIG. 1, but also this configuration according to FIGS. 12 and 13, which allow adjacent wall elements 2 to be arranged, and connected, in a state in which they are tilted slightly in relation to one another, this making it possible to compensate for certain unevenness in the region of the ground surface 19 on which the wall elements 2 are standing.

That which is claimed is:

1. A wall element for use in an assembly for holding back water, wherein the wall element is formed in one piece and has a planar, rectangular main portion having a first side, a second side parallel to the first side, a third side perpendicular to the first side, and a fourth side parallel to the third side, and the wall element has a first planar bearing portion that is connected to the main portion along the length of the first side and extends perpendicular to the plane of the main portion, and a second planar bearing portion that is connected to the main portion along the length of the second side and extends perpendicular to the plane of the main portion, wherein the second bearing portion extends in a direction opposite to a direction of the first bearing portion relative to the plane of the main portion, and the wall element has a first connecting portion that is connected to the main portion along the length of the third side and angled relative to the plane of the main portion, and the connecting portion has a plurality of connecting holes in a longitudinal direction of the connecting portion and passing through the connecting portion, and the main portion has a plurality of connecting holes which correspond to the plurality of connecting holes of the connecting portion and are arranged along the fourth side, wherein a first surface of the first and second bearing portions directed toward the main portion is a contact surface for a plurality of fasteners connecting the wall element to a ground surface, and a second surface of the first and second bearing portions directed away from the main portion is a bearing surface for a seal between the respective bearing surface and the ground surface.

2. The wall element as claimed in claim 1, wherein the wall element consists of a galvanized sheet metal.

3. The wall element as claimed in claim 1, wherein the connecting portion encloses an angle of 120° to 150° relative to the plane of the main portion.

4. The wall element as claimed in claim 1, wherein the contact surface for the fasteners serves to provide contact for a clamping bracket in the two mutually remote end regions of the bearing portion relative to the longitudinal extent of the respective bearing portion and wherein the respective clamping bracket has a mount for the fasteners.

5. The wall element as claimed in claim 1, wherein the contact surfaces for the fasteners serve to provide contact for fasteners in the form of screws or nails, the contact being provided in the region of the head of the fasteners, and wherein the respective bearing portion has connecting holes for the screws or nails.

6. The wall element as claimed in claim 5, wherein adjacent connecting holes of the respective bearing portion are spaced apart from one another by the same distance relative to the longitudinal extent of the bearing portion.

7. The wall element as claimed in claim 1, wherein adjacent connecting holes of the connecting portion are spaced apart from one another by the same distance relative to the longitudinal extent of the connecting portion, and adjacent connecting holes of the main portion are spaced apart from one another by the same distance relative to the longitudinal extent of the fourth side of the main portion, and wherein said distances between adjacent connecting holes of the connecting portion and the main portion are identical, and the distances between those connecting holes of the connecting portion and the main portion which are closest to the extension of the first side of the main portion are identical.

8. The wall element as claimed in claim 7, wherein at least some of the connecting holes of at least one of the connecting portion and the main portion are in the form of a slot.

9. The wall element as claimed in claim 1, wherein the second surface of the first bearing portion or the second bearing portion directed away from the main portion is a bearing surface for adhesive-bonding connection to the seal or for adhesive-bonding insertion of the seal into the first or second bearing portion or for fitting the seal into the first or second bearing portion.

10. An assembly for holding back water, having a plurality of wall elements as claimed in claim 1 arranged in a zigzag form or in a closed configuration with the main portion and the connecting portion of adjacent wall elements connected, and having the seal between the ground surface and the respective bearing portion assigned to the ground surface, and having fasteners which establish contact with the contact surface of the respective bearing portion and are fastened into the ground surface.

11. The assembly as claimed in claim 10, wherein the sealing of the wall elements in the direction of the ground surface takes place via a plurality of seals which are adhesively bonded to the respective bearing portion over the entire length of the bearing portion, or are fitted onto the respective bearing portion from the ground surface beneath the bearing portion over the entire length of the respective bearing portion with additional adhesive bonding, or are fitted onto the respective bearing portion along the transverse extent of the bearing portion.

12. The assembly as claimed in claim 10, wherein the seal is in the form of at least one of a lip seal, a seal made of sponge rubber, a seal made of foam rubber, and a seal which hardens under the action of water.

13. The assembly as claimed in claim 10, wherein a clamping bracket has a central through-hole for the fastener, and the clamping bracket on a first side has two end-side edges which enclose an angle greater than 180° and on a second side directed away from the first side has two end-side edges which enclose an angle less than 180°.

14. The assembly as claimed in claim 10, wherein the assembly has at least one support connected to a wall element and connected to the ground surface by fastening means.

15. The assembly as claimed in claim 10, wherein the assembly is a flood-protection wall or an encircling wall of a water basin.

* * * * *